US007806350B2

(12) United States Patent
Langiewicz et al.

(10) Patent No.: US 7,806,350 B2
(45) Date of Patent: Oct. 5, 2010

(54) SPRAY NOZZLE

(76) Inventors: Craig A. Langiewicz, 3215 134th Ave. NE., Ham Lake, MN (US) 55304; Gilbert Pangburn, 12103 Oak Park Blvd., Blaine, MN (US) 55434

( * ) Notice: Subject to any disclaimer, the term of this patent is extended or adjusted under 35 U.S.C. 154(b) by 337 days.

(21) Appl. No.: 11/868,240

(22) Filed: Oct. 5, 2007

(65) Prior Publication Data

US 2008/0116298 A1 May 22, 2008

Related U.S. Application Data

(60) Provisional application No. 60/850,363, filed on Oct. 6, 2006.

(51) Int. Cl.
*B05B 1/00* (2006.01)

(52) U.S. Cl. ..... 239/600; 239/505; 239/522; 239/524; 239/595

(58) Field of Classification Search ..... 239/501, 239/505, 506, 509, 512, 513, 522, 523, 524, 239/595, 600

See application file for complete search history.

(56) References Cited

U.S. PATENT DOCUMENTS

| | | | | |
|---|---|---|---|---|
| 1,639,162 | A | 8/1927 | Brooks | |
| 2,338,273 | A | 1/1944 | Wilkins | |
| 2,539,061 | A | 1/1951 | Coles | |
| RE24,353 | E * | 9/1957 | Kromer | 239/505 |
| 3,085,754 | A | 4/1963 | Thompson | |
| 3,109,593 | A * | 11/1963 | Newland, Sr. | 239/275 |
| 3,189,283 | A * | 6/1965 | Moore | 239/222.17 |
| 3,468,484 | A * | 9/1969 | Hunter | 239/204 |
| 4,461,426 | A * | 7/1984 | Christopher | 239/394 |
| 4,624,414 | A | 11/1986 | Ferrazza | |
| 5,076,497 | A | 12/1991 | Rabitsch | |
| D325,428 | S | 4/1992 | Vitsur | |
| 5,240,184 | A | 8/1993 | Lawson | |
| 5,620,142 | A | 4/1997 | Elkas | |
| D458,342 | S | 6/2002 | Johnson | |
| D473,927 | S | 4/2003 | Johnson | |
| D474,255 | S | 5/2003 | Johnson | |
| D480,125 | S | 9/2003 | Johnson | |
| 7,108,204 | B2 * | 9/2006 | Johnson | 239/522 |
| 2003/0146303 | A1 | 8/2003 | Johnson | |
| 2004/0227015 | A1 | 11/2004 | Johnson | |

OTHER PUBLICATIONS

Catalog—W.L. Hamilton & Co., Marshall, Michaigan, 1986, pp. 17, 18 and 23.

Catalog—Kuker Industries, Inc., Omaha, Nebraska, 1994, pp. 54 and 57.

* cited by examiner

*Primary Examiner*—Dinh Q Nguyen
(74) *Attorney, Agent, or Firm*—Merchant & Gould P.C.

(57) ABSTRACT

A spray nozzle includes a body and a deflector. The body is aligned and connected to the deflector with a fastener. At least one pin can be used to further align the deflector relative to the body. A single mating surface is provided on each of the body and the deflector.

28 Claims, 9 Drawing Sheets

SPRAY NOZZLE

CROSS REFERENCE TO RELATED APPLICATIONS

This application claims priority to U.S. Provisional Application No. 60/850,363 filed on Oct. 6, 2006, entitled SPRAY NOZZLE, the disclosure of which is incorporated by reference herein in its entirety.

TECHNICAL FIELD

This disclosure relates to spray nozzles and methods of manufacturing spray nozzles.

BACKGROUND

Spray nozzles are used in a variety of applications to convert a fluid stream into a particular spray pattern. It is often desirable to apply a fluid in a uniform and consistent manner upon a target location. Various spray nozzle designs have been developed in an attempt to generate an appropriate spray pattern.

Some spray nozzle designs include a body that receives the fluid input and passes it through an orifice to a deflector connected to the body. The deflector is positioned opposite the fluid input. The deflector deflects the fluid into a particular spray pattern as the fluid comes out of the body orifice.

SUMMARY

The present disclosure relates to spray nozzles having a body and a deflector. The body is aligned and connected to the deflector with a fastener. At least one pin can be used to further align the deflector relative to the body. The alignment pin can provide improved alignment of the body and deflector. A single mating surface is provided on each of the body and the deflector. The use of a single mating surface can help reduce the cost of manufacturing and improve a seal formed between the body and the deflector that reduces incidence of fluid buildup. There is no requirement that an arrangement include all features characterized herein to obtain some advantage according to this disclosure.

DETAILED DESCRIPTION

Figure 1:
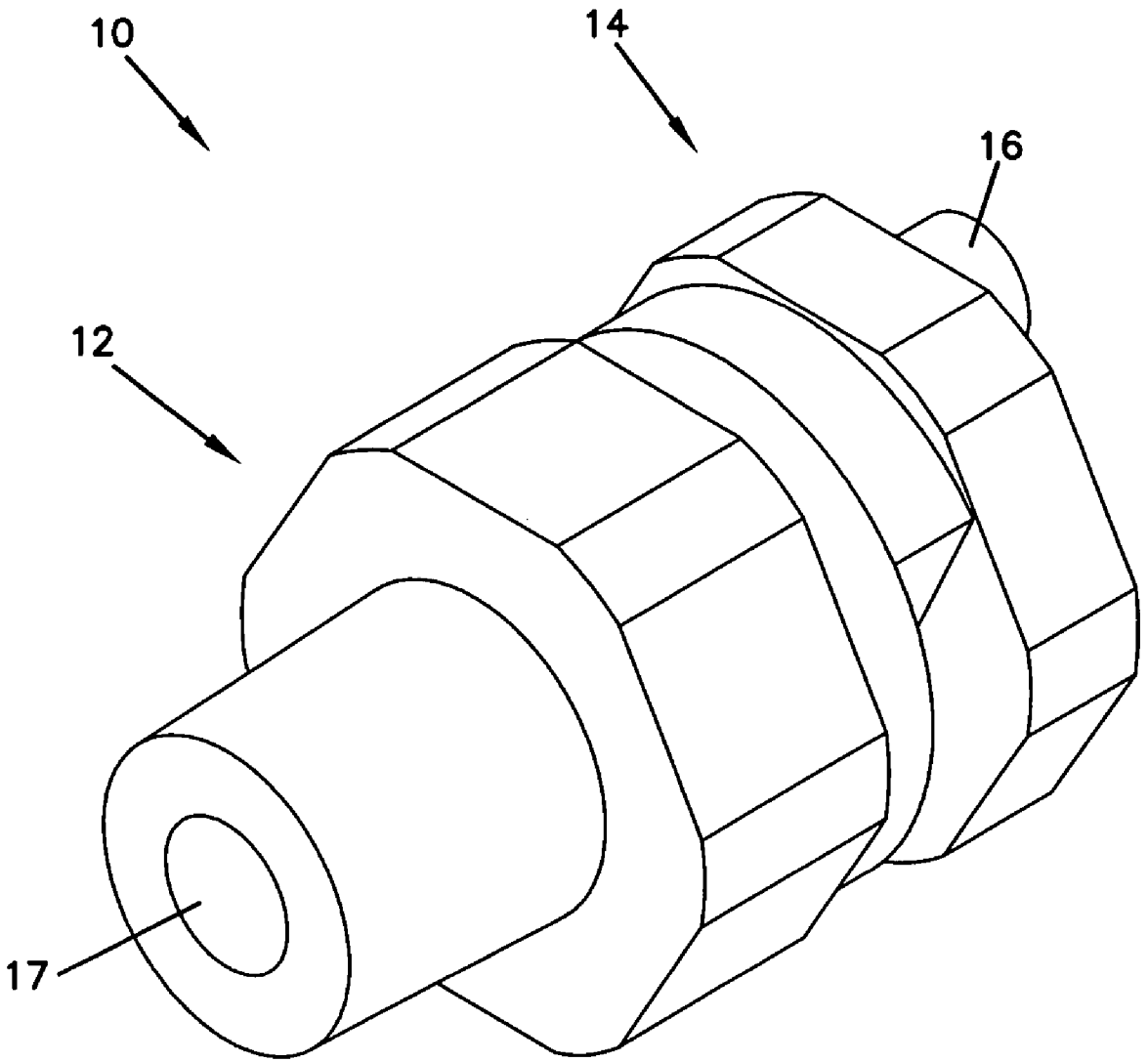
FIG. 1 is a schematic perspective view of an example spray nozzle having a body and a deflector.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A number of shortcomings are common with conventional spray nozzles. One shortcoming involves misalignment of the body and the deflector. Alignment of the body and the deflector is important to the development of a uniform spray pattern. If the body is misaligned with the deflector, the fluid will not be applied to the appropriate location on the deflector, resulting in a non-uniform or misshaped spray pattern. Even a small misalignment can result in a large change in the spray pattern.

One way in which misalignment between the body and deflector occurs is due to the imprecision of a fastener connection. To connect the body to the deflector, a fastener hole is formed in the deflector and a threaded hole is formed in the body. The size of the fastener hole is larger than the size of the fastener passing through the deflector and into threaded engagement with the threaded hole, to enable the fastener to be easily inserted. Therefore, when the fastener is inserted, a small amount of space exists between the fastener and the fastener hole, allowing misalignment to occur between the deflector and the body.

The mating surfaces between the body and deflector can also be important to the design of a spray nozzle. One spray nozzle design includes L-shaped mating surfaces between the deflector and body resulting in four to six mating surfaces. Creating a mating surface can be expensive and difficult due to precise machining requirements needed for proper alignment between parts. The inclusion of more than two mating surfaces (i.e., one on each of the body and deflector) can create problems with tolerance stacks that further enhance the need for precise machining and increase the probability of misalignment. Any misalignment between parts can result in fluid intrusion into spaces between the mating surfaces. Fluid buildup between mating surfaces can result in fluid dripping from the spray nozzle. In addition, misalignment of the body and deflector from improperly machined or positioned mating surfaces can result in undesirable spray patterns. Embodiments according to the present disclosure address these and other shortcomings of existing spray nozzles.

Figure 2:
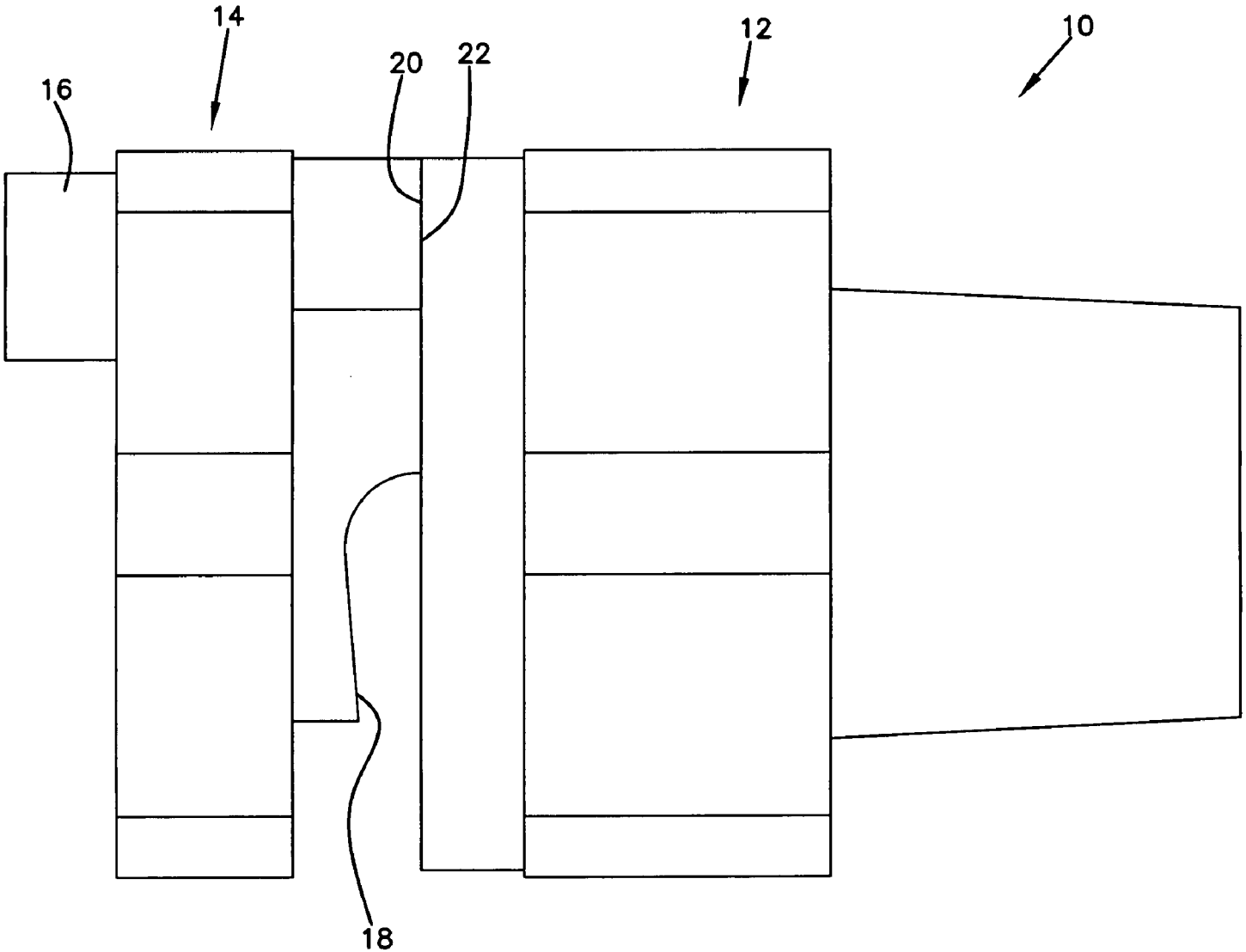
FIG. 2 is a schematic right side view of the spray nozzle shown in FIG. 1.

An example spray nozzle 10 is shown in FIGS. 1-2. FIG. 1 is a schematic perspective view of an example spray nozzle 10 including body 12, deflector 14, and fastener 16. Body 12 and deflector 14 are connected together by the fastener 16 (e.g., a screw or bolt). The fastener 16 is inserted through fastener holes (not shown) in body 12 and deflector 14. Spray nozzle 10 is typically connected at one end to an input line of a fluid source, such as a fluid delivery system that provides a flow of fluid to spray nozzle 10. Fluid enters spray nozzle 10 through an axially-extending orifice 17 through the core of body 12. The fluid is expelled from the orifice 17 into a cavity defined between body 12 and deflector 14 and then onto a deflection surface of deflector 14. Deflector 14 is designed to convert the fluid stream into a desired spray pattern for application of the fluid onto a target location.

The construction of spray nozzle 10 begins, for example, with a length of hexagonal-shaped stock (hereinafter referred to as "hex stock"). The hex stock can be rough cut such that small variations and inconsistencies exist from piece to piece. The use of rough cut hex stock can reduce manufacturing costs. The hex stock is cut into two pieces, one that becomes body 12 and one that becomes deflector 14. Additional steps are then performed, as described herein.

FIG. 2 is a schematic side view of spray nozzle 10 including body 12, deflector 14, and fastener 16, and further including deflection surface 18 and mating surfaces 20 and 22. Deflection surface 18 is formed adjacent body 12 on deflector 14. Deflection surface 18 is shaped to deflect fluid expelled from body 12 out from spray nozzle 10 in a desired spray pattern.

Mating surface 20 is the distal surface of body 12 (relative to the fluid input) and mating surface 22 is the proximal surface of deflector 14. When body 12 and deflector 14 are properly connected, mating surfaces 20 and 22 are facing each other in a mating arrangement. Mating surfaces 20 and 22 can be highly polished surfaces, such that when mated together form a tight seal against fluid intrusion. For example, the surface can be polished to have a surface variation from about 3 microns to about 10 microns, and preferably from about 5 microns to about 6 microns.

Figure 3:
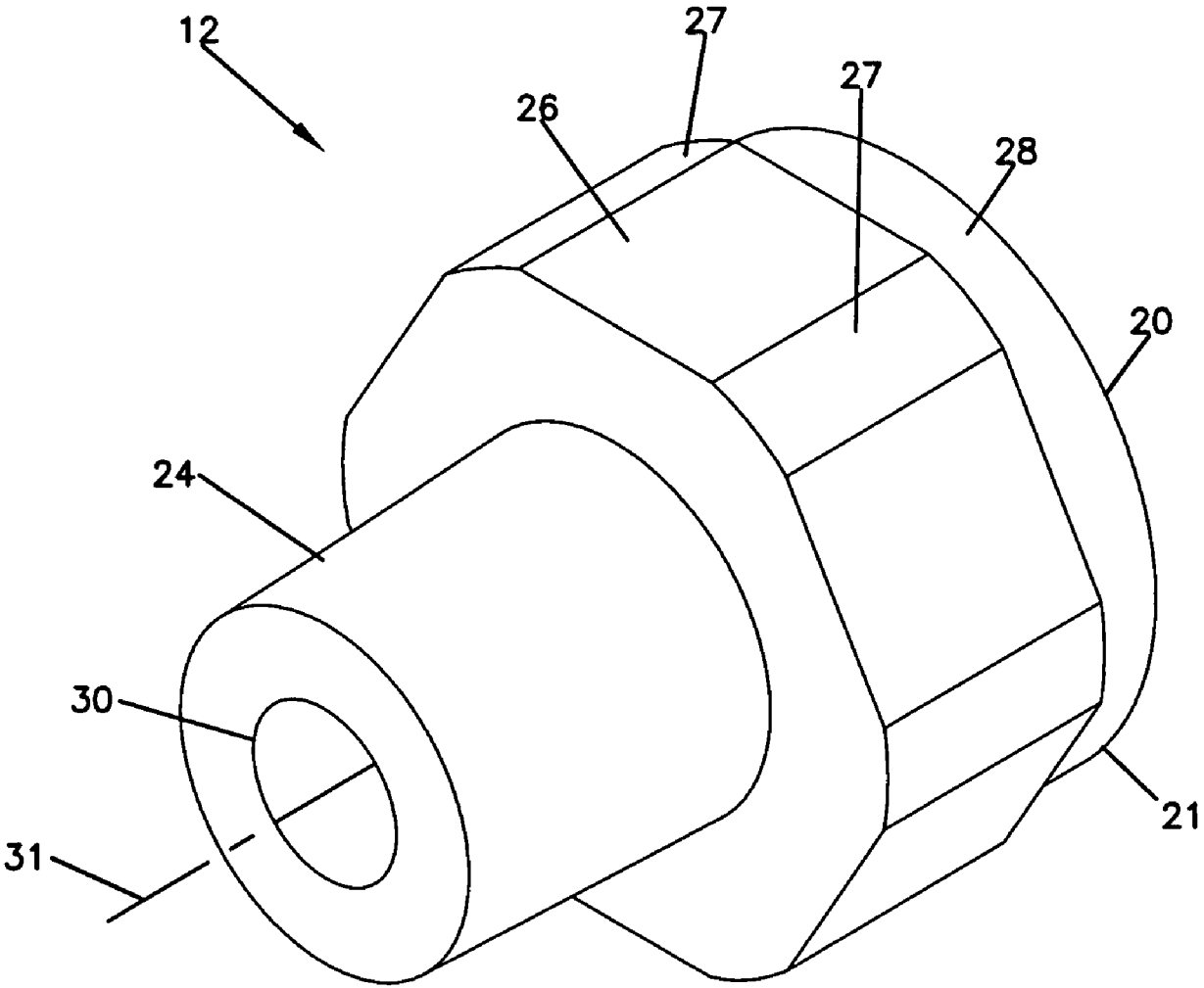
FIG. 3 is a schematic perspective view of the body of the spray nozzle shown in FIG. 1.
Figure 5:
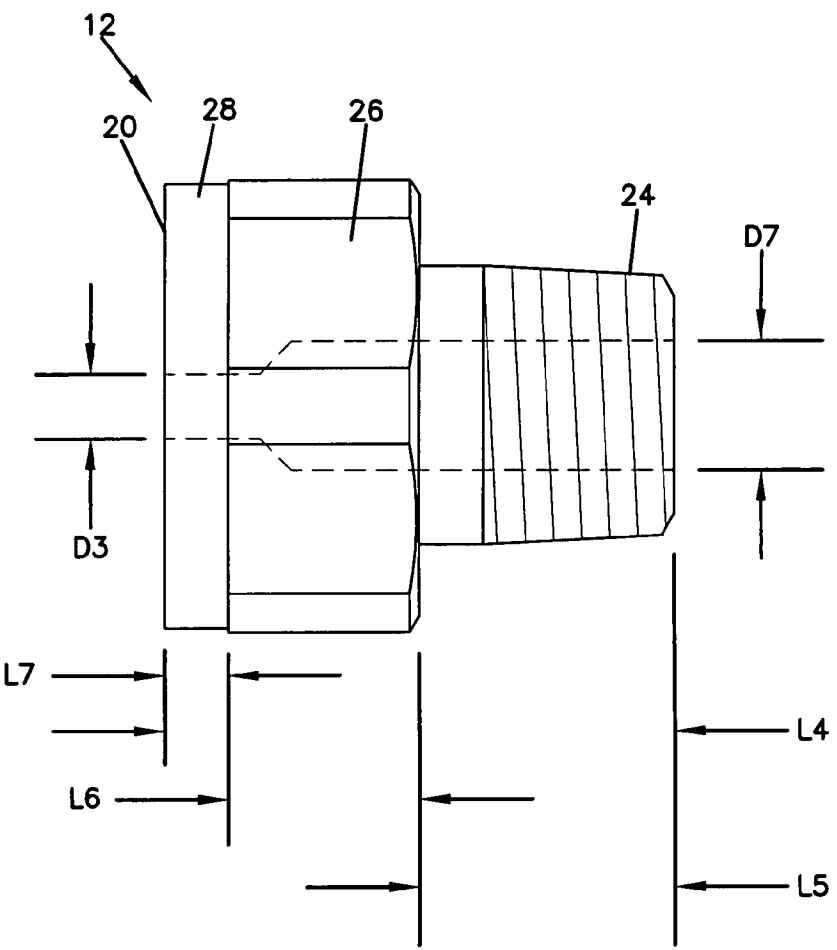
FIG. 5 is a schematic right side view of the body shown in FIG. 1.
Figure 4:
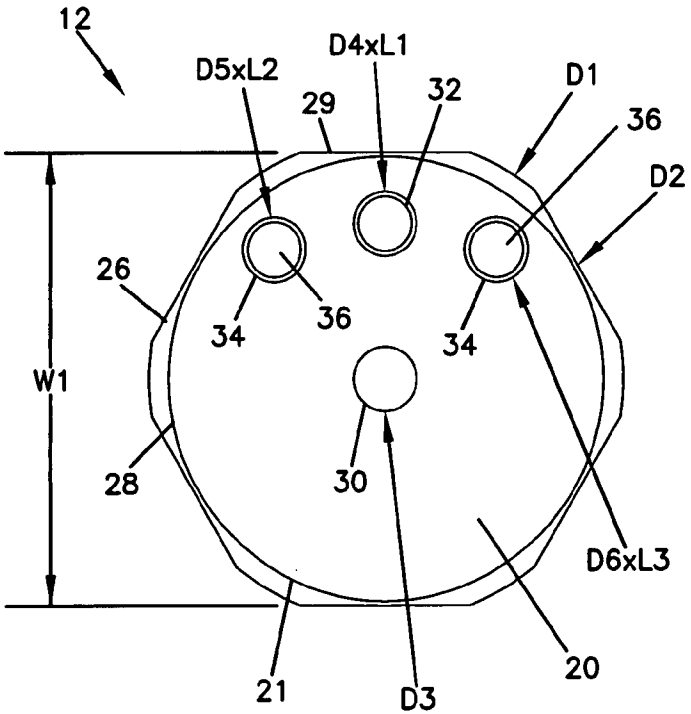
FIG. 4 is a schematic front view of the deflection edge of the body shown in FIG. 1.

FIGS. 3-5 illustrate an example body 12 of the spray nozzle 10 shown in FIG. 1. FIG. 3 is a schematic perspective view. Body 12 includes mating surface 20, adapter 24, hex region 26, corner round 27, recessed portion 28, and orifice 30. Adapter 24 is positioned adjacent to hex region 26 and opposite recessed portion 28 and mating surface 20. Adapter 24 is designed to connect with a fluid input line, such as a hose or other fluid delivery system. The adapter 24 can be formed, for example, by grinding from the hex stock. In some embodiments, adapter 24 has a cylindrical cross-section or has a tapered shape with a cylindrical cross-section. Adapter 24 can include fastener threads, if desired, for mating with a connector of the fluid input line.

Hex region 26 is adjacent to adapter 24 of body 12. Hex region 26 includes rounded corners, referred to as corner round 27. One purpose of corner round 27 is to provide a precisely cut feature in the original rough cut hex stock from which to measure and position subsequently formed features. Each corner of corner round 27 has a precise radius measured from central axis 31 of orifice 30, and is separated from adjacent corners by the flat sides of the original hex stock.

Adjacent to hex region 26 and opposite adapter 24 is recessed portion 28. The diameter of recessed portion 28 is smaller than the diameter of corner round 27, such that the recessed portion 28 defines a region with cylindrical cross-section radially inward from the outer flat surfaces of the hex stock. Mating surface 20 is formed on one side of recessed portion 28, opposite hex region 26.

In some embodiments, recessed portion 28 and mating surface 20 perform two functions. First, as described above, mating surface 20 mates with mating surface 22 of deflector 14. When highly polished, mating surface 20 forms a fluid tight seal with mating surface 22 to avoid fluid intrusion between body 12 and deflector 14. Second, after fluid has deflected off of deflection surface 18, the fluid can also come into contact with the portion of mating surface 20 not mated with mating surface 22. A rounded edge 21 defined at the intersection of the surface 20 and the recessed portion 28 provides a uniform deflection surface that defines, in part, the shape and uniformity of the resulting spray pattern.

Orifice 30 extends longitudinally through the core of body 12 to provide a path for fluid flow through body 12. Orifice 30 can have a consistent diameter throughout or may narrow near mating surface 20 to reduce the amount of fluid flow and/or increase the fluid pressure.

FIG. 4 is a schematic front view of mating surface 20 of body 12 illustrating hex region 26, recessed portion 28, orifice 30, and fastener hole 32 as previously described, and also illustrating pin holes 34 and pins 36. Orifice 30 extends entirely through the core of body 12, as described above. Orifice 30 is formed, for example, by drilling through body 12 along a central axis relative to corner round 27. If desired, the orifice can be formed (e.g., by drilling) entirely through at a smaller diameter and then formed partially through at a larger diameter. This provides a larger diameter orifice within adapter 24 and a smaller diameter orifice within recessed portion 28 to increase the pressure of fluid as it exits body 12.

Threaded fastener hole 32 is a longitudinal hole drilled into mating surface 20 of body 12. Threaded fastener hole 32 typically extends partially through body 12. Threaded fastener hole 32 provides threaded engagement with the threads of fastener 16 to connect body 12 with deflector 14. In the illustrated arrangement, fastener hole 34 is located on a line between orifice 30 and a flat edge 29 of hex region 26.

Spray nozzle 10 includes at least one alignment pin 36, and preferably two or more alignment pins 36. Alignment pins 36 are placed into pin holes 34 that are longitudinally formed in mating surface 20 of body 12. Pin holes 34 typically extend at least partially through body 12. The pin holes 34 are located on an opposite side of fastener hole 32. The pin holes 34 are spaced approximately equal distance from orifice 30 as the spacing of fastener hole 32 from orifice 30. Pins 36 fit into pin holes 34 and also into adjacent pin holes in deflector 14 (e.g., pin holes 44 shown in FIG. 6). The use of alignment pins 36 provides additional stability to spray nozzle 10 and more precisely align deflector 14 with body 12.

In other embodiments, pin holes can be formed in alternate positions within mating surface 20. For example, pin holes need not be uniformly spaced from fastener hole 32, but rather can be formed at any desired location and in any desired arrangement. In addition, the sizing of pin holes and the associated pins can be any desirable size.

Pins 36 provide greater stability and alignment than is possible through the use of fastener 16 alone. As discussed above, fastener hole 46 of the deflector (see FIG. 6) must be made slightly larger than the maximum outer diameter of that portion of fastener 16 extending through fastener hole 46 to enable fastener 16 to pass through the deflector and make threaded engagement with fastener hole 32. The spacing between fastener 16 and fastener hole 46 leaves room for undesirable movement, allowing deflector 14 and body 12 to become misaligned when assembled. Pins 36 can be closely sized (e.g., with an interference fit) to the size of pin holes 34, thereby reducing the room available for movement and misalignment. Furthermore, the use of two alignment pins tightly fit in pin holes 36, 44 can reduce the possibility of movement between the body 12 and deflector 14.

Rough dimensions for an example body 12 will now be provided with reference to FIGS. 4 and 5. Width W1 of the rough hex stock is typically in a range from about 0.8 inches to about 1.0 inch, and preferably from about 0.87 to about 0.89 inches. Corner round 27 reduces the corners of the hex stock to have diameter D1 that is typically in a range from about 0.8 inches to about 1.0 inch, and preferably from about 0.93 inches to about 0.95 inches. Recessed portion 28 has diameter D2 that is typically in a range from about 0.8 inches to about 1.0 inch, and preferably from about 0.85 inches to about 0.87 inches.

Orifice 30 has diameter D3 within recessed portion 28 that is typically in a range from about 0.11 inches to about 0.14 inches, and preferably from about 0.12 inches to about 0.14 inches. Fastener hole 32 has diameter D4 that is typically in a range from about 0.17 inches to about 0.21 inches, and preferably from about 0.18 inches to about 0.20 inches. Fastener hole 32 has length L1 that is typically in a range from about 0.3 inches to about 0.4 inches, and preferably from about 0.37 inches to about 0.39 inches. L1 is long enough to provide adequate engagement with fastener 16, but not so long as to extend entirely through hex region 26.

One or more pin holes 34 have diameter D5 that is typically in a range from about 0.11 inches to about 0.14 inches, and preferably from about 0.12 inches to about 0.14 inches. Pin holes 34 have length L2 that is typically in a range from about 0.2 inches to about 0.3 inches, and preferably from about 0.24 inches to about 0.26 inches. Pin holes of approximately the same size are also drilled into the adjacent surface of deflector 14 (e.g., see pin holes 44 shown in FIG. 4). Pins 36 have diameter D6 that is typically in a range from about 0.0005 inches to about 0.002 inches less than D5, and preferably from about 0.0009 inches to about 0.0011 inches less than D5. Similarly, pins 36 have length L3 that is typically in a range from about 0.001 inches to 0.003 inches less than L2, and preferably from about 0.0019 inches to about 0.0021 inches less than L2. Pins 36 can have an outer diameter that is about 97 percent to about 100 percent of the inside diameter of pin holes 34. Depending on the materials used for pins 36, the outer diameter of the pins 36 can be even smaller than pin holes 34 such as in the range of about 80 percent to about 100 percent of the inner diameter of pin holes 34.

FIG. 5 is a schematic side view of body 12 including mating surface 20, adapter 24, hex region 26, recessed portion 28, and orifice 30.

To further aid in understanding the example body 12, rough dimensions are provided from this alternate view. Body 12 has overall length L4 that is typically in a range from about 0.9 inches to about 1.1 inches, and preferably from about 0.99 inches to about 1.01 inches. Adapter 24 has length L5 that is typically in a range from about 0.45 inches to about 0.55 inches, and preferably from about 0.49 inches to about 0.51 inches. Hex region 26 has length L6 that is typically in a range from about 0.34 inches to about 0.41 inches, and preferably from about 0.37 to about 0.39 inches. Recessed portion 28 has length L7 that is typically in a range from about 0.11 inches to 0.14 inches, and preferably from about 0.12 inches to about 0.13 inches.

In one embodiment, adapter 24 includes fastener threads that enable adapter 24 to be connected to a hose or other fluid delivery system. Standard fastener threads can be used, such as sizes in the range from about 0.0625 inch National Pipe Thread (NPT) to 0.5 inch NPT, and preferably from about 0.125 inch NPT to about 0.375 inch NPT having an outer diameter from about 0.405 inches to about 0.675 inches and having from about 18 to about 27 threads per inch. In this case, orifice 30 has diameter D7 equivalent to the standard size, such as 0.25 inches for 0.25 inch NPT. As described above, D7 can taper toward mating surface 20, if desired. For example, orifice 30 has diameter D7 for about 0.5 inches to about 0.9 inches, and then tapers to diameter D3 for about 0.1 inches to about 0.5 inches.

Figure 9:
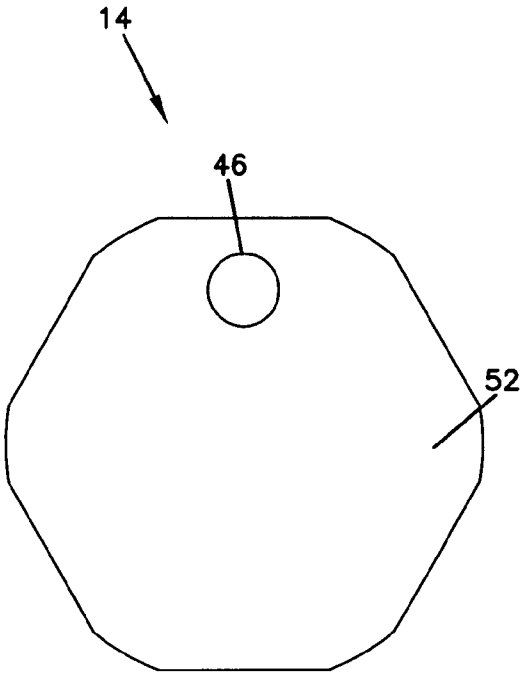
FIG. 9 is a schematic front view of a face of the deflector shown in FIG. 1.
Figure 12:
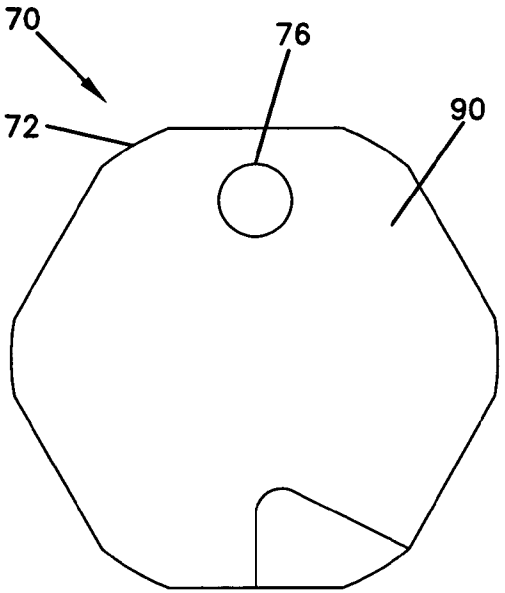
FIG. 12 is a schematic end view of a front of the right-hand spray nozzle deflector shown in FIG. 10.
Figure 11:
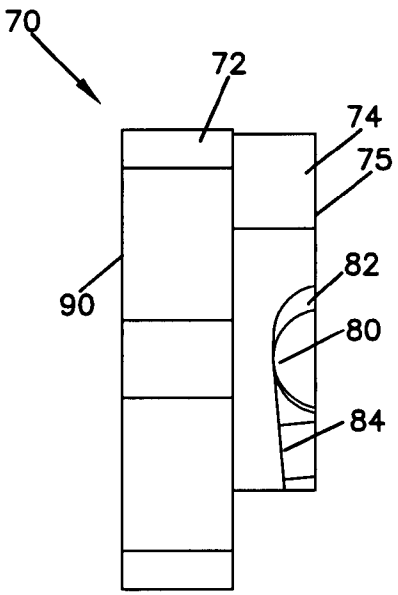
FIG. 11 is a schematic right side view of the right-hand spray nozzle deflector shown in FIG. 10.
Figure 10:
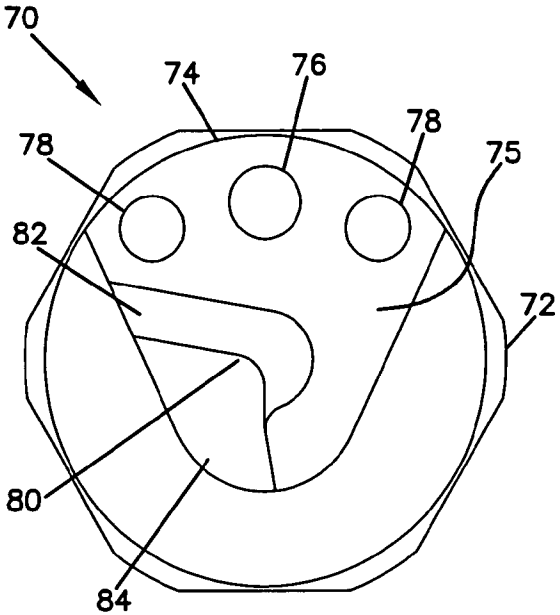
FIG. 10 is a schematic end view of an example right-hand spray nozzle deflector.
Figure 15:
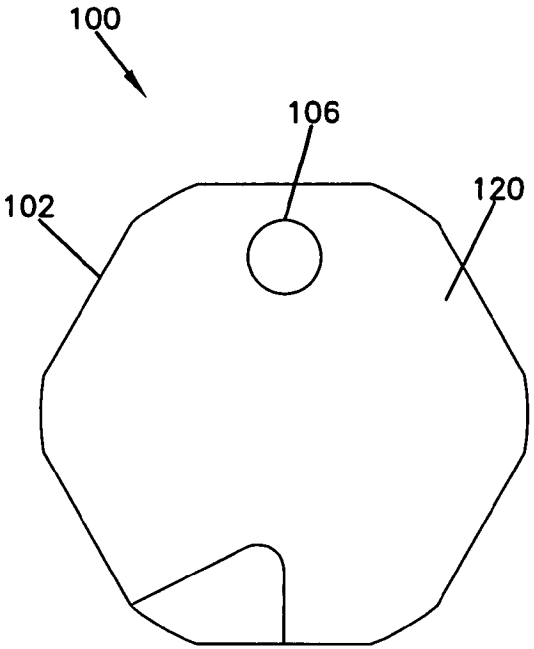
FIG. 15 is a schematic front view of the distal end of the left-hand spray nozzle deflector shown in FIG. 13.
Figure 14:
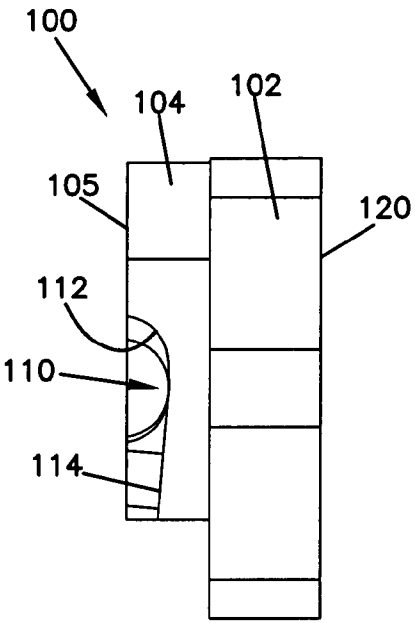
FIG. 14 is a schematic left side view of the left-hand spray nozzle deflector shown in FIG. 13.
Figure 13:
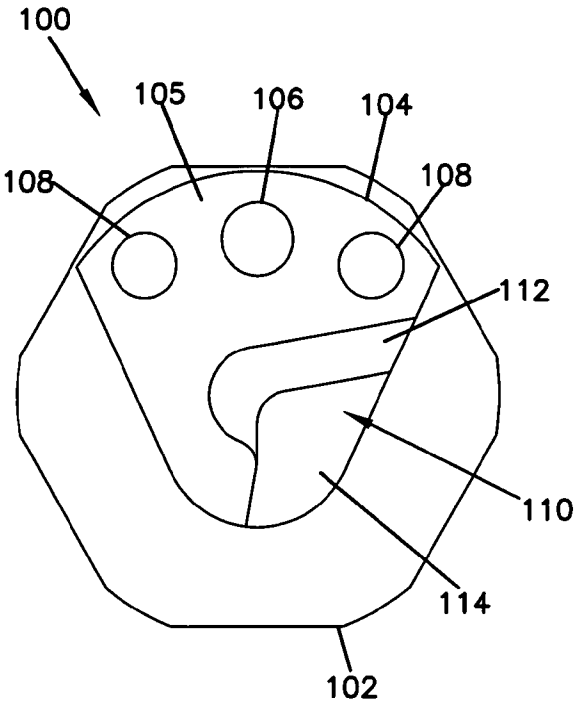
FIG. 13 is a schematic end view of an example left-hand spray nozzle deflector.
Figure 18:
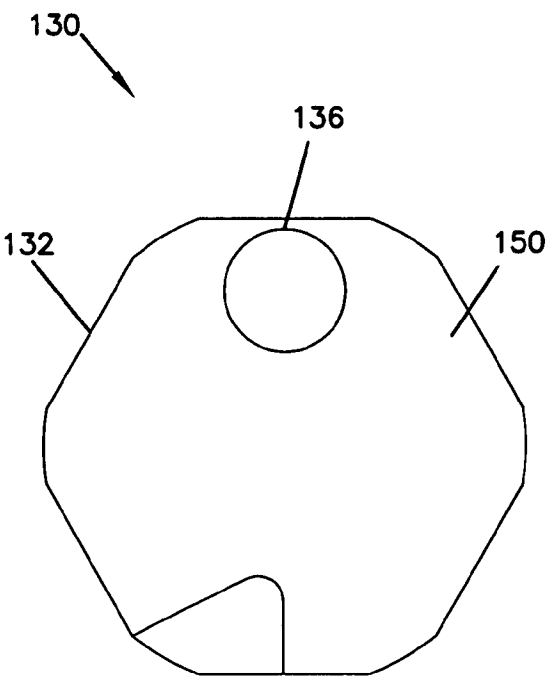
FIG. 18 is a schematic front view of the distal end of the left-hand deflector shown in FIG. 16.
Figure 17:
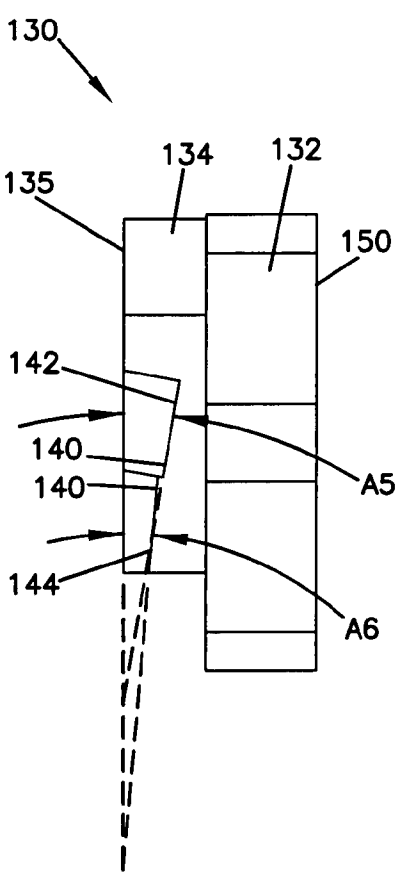
FIG. 17 is a schematic left side view of the example left-hand deflector shown in FIG. 16.
Figure 16:
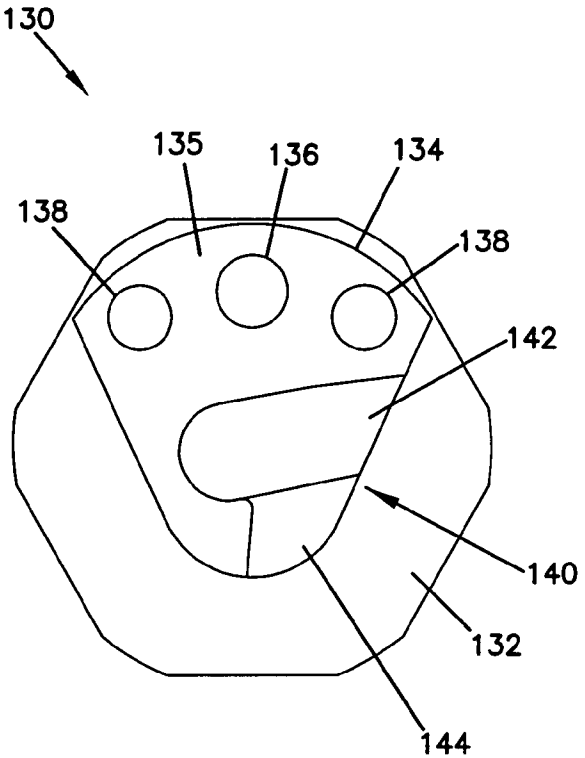
FIG. 16 is a schematic end view of another example left-hand deflector.

FIGS. 6-15 illustrate an example deflector 14 of spray nozzle 10 shown in FIG. 1. The primary purpose of deflector 14 is to deflect a fluid flow from body 12 into a desired spray pattern. Any number of different deflection patterns can be designed by adjusting the size and shape of the edge of deflection surface 18. In this disclosure, four examples are provided illustrating various designs of deflection edge 18 of deflector 14. FIGS. 6-9 illustrate a full deflection pattern deflector that sprays a uniform spray pattern of approximately 180 degrees, about 90 degrees to each side. FIGS. 10-12 illustrate a right-hand deflection pattern deflector that sprays a uniform spray pattern of approximately 90 degrees to the right side. FIGS. 13-15 illustrate a left-hand deflection pattern deflector that sprays a uniform spray pattern of approximately 90 degrees to the left side. FIGS. 16-18 illustrate another embodiment of a left-hand deflection pattern deflector that sprays a uniform spray pattern of approximately 90 degrees to the left-hand side.

Figure 6:
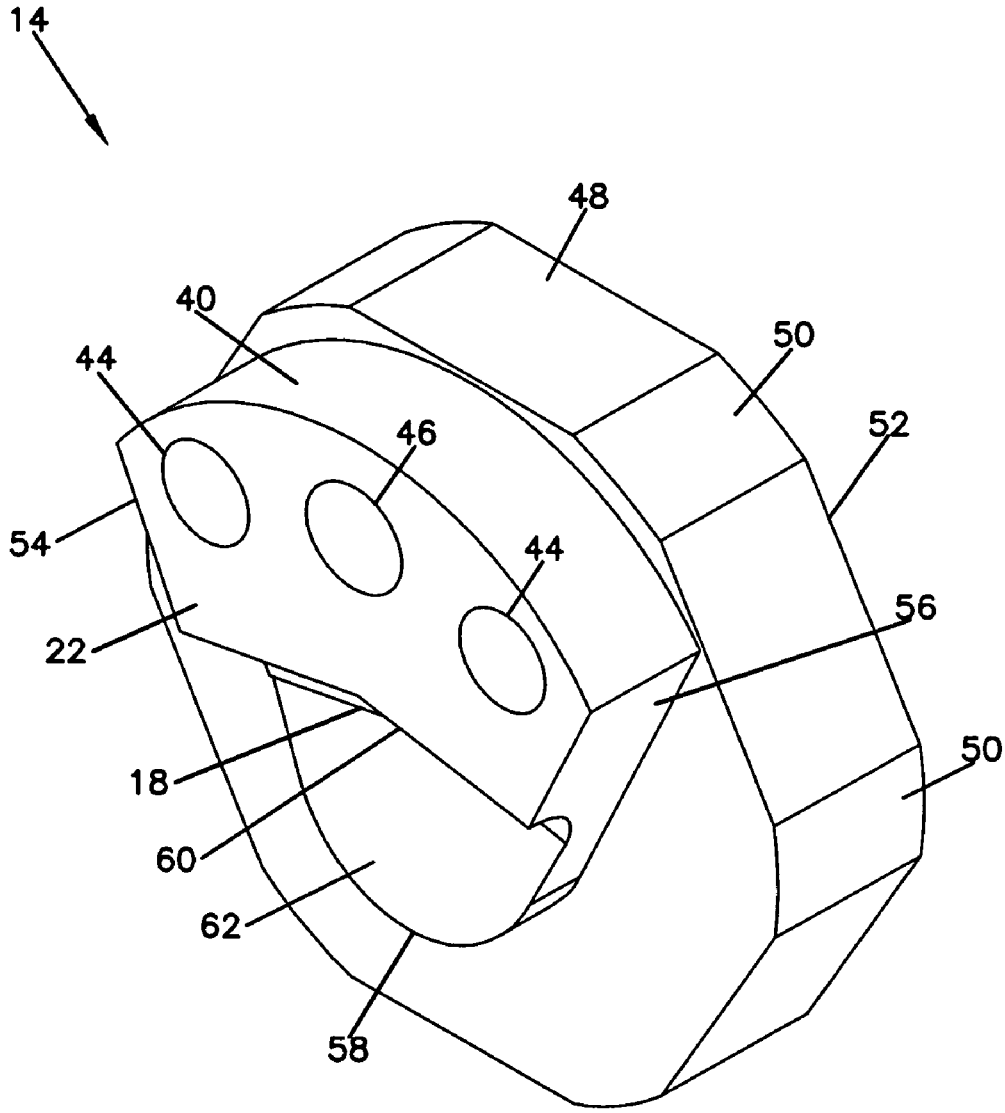
FIG. 6 is a schematic perspective view of the deflector shown in FIG. 1.

FIG. 6 is a schematic perspective view of one embodiment of deflector 14. Deflector 14 includes recessed portion 40 and hex region 48. Recessed portion 40 includes mating surface 22, one or more pin holes 44, fastener hole 46, deflection surface 18, sides 54 and 56, and curved portion 58. Deflection surface 18 includes radius portion 60 and flat portion 62. Hex region 48 includes corner round 50 and face 52.

Hex region 48 is adjacent recessed portion 40 and opposite mating surface 22. Hex region 48 is typically formed during at least some of the same processing steps as hex region 26 of body 12 (see FIG. 3). Rough hex stock is cut to length, and corner round 50 is then ground into the corners of hex region 48 to form precisely formed features that can be used for the alignment and measurement of subsequently formed features.

Recessed portion 40 is then formed by grinding a cylindrical shape into the hex stock until the diameter of recessed portion 40 is entirely within the hex stock, such that a complete circle cross-section is formed with no flat edges. Sides 54 and 56 are then formed in recessed portion 40 at a desired angle, by removing sections of recessed portion 40. Lines passing through the planes of sides 54 and 56 converge approximately at a point on an imaginary circle drawn through corner round 50. The angle formed by sides 54 and 56 is angle A1, shown and described below with reference to FIG. 7.

Curved portion 58 is then formed to connect sides 54 and 56 with an arc. The arc is centered at the center of corner round 50 and can have a circular shape.

Deflection surface 18 is formed in recessed portion 40 between sides 54 and 56 and adjacent curved portion 58. Deflection surface 18 includes the area of recessed portion 40 directly in line with the center of corner round 50. In this way, a portion of deflection surface 18 is directly in line with orifice 30 of body 12 when body 12 and deflector 14 are connected together. Deflection surface 18 includes a radius or fillet portion 60 (also referred to as a concave portion 60) and flat portion 62 (see also FIG. 8). Radius portion 60 includes a right side and a left side that each slope gradually in opposite directions and terminates at one of sides 54 and 56. The sides of radius portion 60 form angle A2, shown and described below with reference to FIG. 7. Radius portion 60 curves from mating surface 22 of recessed portion 40 to flat portion 42. Flat portion 42 extends from radius portion 60, opposite mating surface 42, to curved portion 58 and between sides 54 and 56.

During operation, fluid passing through body 12 is expelled onto deflection surface 18 of deflector 14. Radius portion 60 and flat portion 62 function together to distribute the fluid evenly into a uniform spray out from deflector 14. The full deflection spray pattern radiates out from a central region of deflector 14 in an arc from about 160 degrees to about 200 degrees.

Pin holes 44 and fastener hole 46 are drilled into mating surface 42 of deflector 14, and extend laterally into deflector 14. Formation of pin holes 44 and fastener hole 46 can be done in the same manner as fastener hole 32 and pin holes 34 of body 12, previously described. Pin holes 44 and fastener hole 46 are aligned such that they will match with the respective holes in body 12. Precise alignment can be achieved by measuring hole locations from corner round 50 of deflector 14, which matches corner round 27 of body 12.

Figure 7:
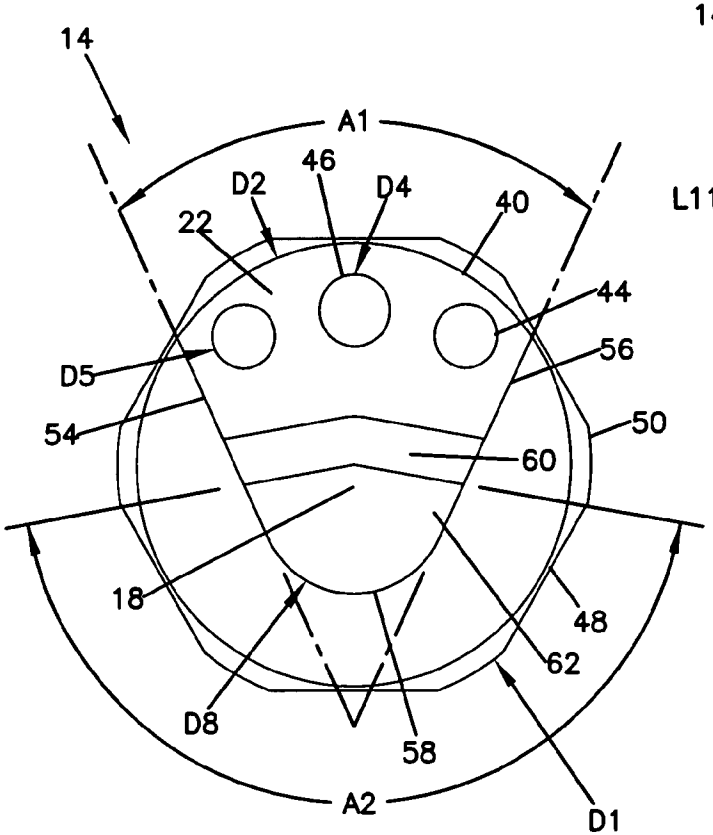
FIG. 7 is a schematic end view of a deflection surface of the deflector shown in FIG. 1.

FIG. 7 is a schematic end view of deflection surface 18 of deflector 14. Deflector 14 includes recessed portion 40 and hex region 48. Recessed portion 40 includes deflection surface 18, mating surface 22, at least one pin hole 44, fastener hole 46, sides 54 and 56, and curved portion 58. Deflection surface 18 includes radius portion 60 and flat portion 62. Hex region 48 includes corner round 50.

Rough dimensions will now be provided for an example deflector 14. Deflector 14 is formed from rough hex stock having width W1 in the range from about 0.8 inches to about 1.0 inch, and preferably from about 0.87 inches to about 0.89 inches. Corner round 50 reduces the corners of the hex stock to have diameter D1 in the range of about 0.8 inches to 1.0 inch, and preferably from about 0.93 inches to about 0.95 inches. Recessed portion 40 has diameter D2 in the range of about 0.8 inches to about 1.0 inch, and preferably from about 0.85 inches to about 0.87 inches. Fastener hole 46 has diameter D4 in the range of about 0.1 inches to 0.2 inches, and preferably from about 0.18 to about 0.19 inches, and extends entirely through deflector 14. One or more pin holes 44 have diameter D5 in the range of about 0.11 inches to about 0.14 inches, and preferably from about 0.12 inches to about 0.13 inches. Pin holes 44 have length L2 in the range of about 0.22 inches to 0.28 inches, and preferably from about 0.24 inches to about 0.26 inches. Curved portion 58 has diameter D8 from about 0.3 inches to 0.4 inches, and preferably from about 0.37 inches to about 0.39 inches.

Figure 8:
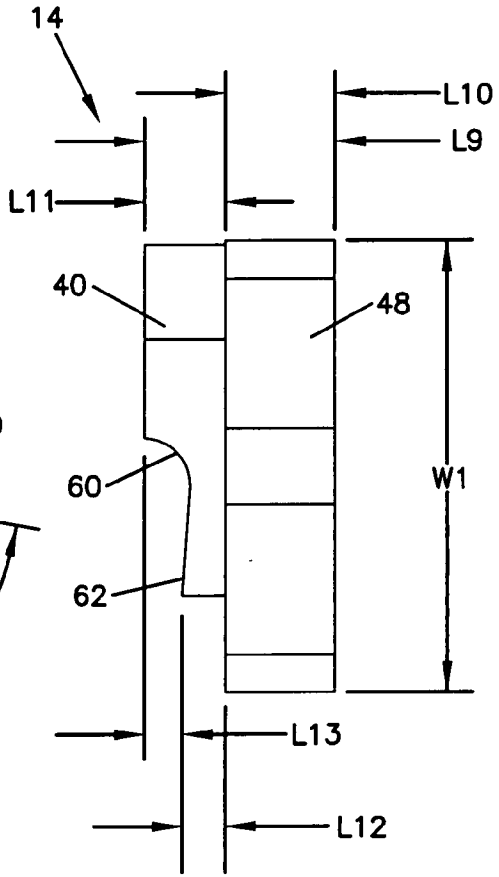
FIG. 8 is a schematic left side view of the deflector shown in FIG. 1.

FIG. 8 is a schematic side view of deflector 14. To further aid in understanding one embodiment, rough dimensions are provided from this alternate view. Deflector 14 has overall length L9 in the range of about 0.3 inches to 0.4 inches, and preferably from about 0.37 inches to about 0.39 inches. Hex region 48 has length L10 in the range of about 0.19 inches to about 0.24 inches, and preferably from about 0.21 inches to about 0.23 inches. Recessed portion 40 has length L11 in the range of about 0.14 inches to 0.18 inches, and preferably from about 0.15 inches to about 0.17 inches. Flat portion 62 has length L12 in the range of about 0.07 inches to 0.1 inches, and preferably from about 0.084 inches to about 0.086 inches. As a result, when deflector 14 is connected with body 12, gap L13 is formed between mating surface 20 (see FIG. 2) and flat portion 62 in the range from about 0.07 inches to about 0.08 inches, and preferably from about 0.074 inches to about 0.075 inches.

FIG. 9 is a schematic front view of face 52 of deflector 14. Deflector 14 includes fastener hole 46, and face 52. Face 52 provides a convenient location for printing or engraving a logo, symbol or other identifying mark on spray nozzle 10. In one example, a symbol indicating a right, left, or full spray patter is included on face 52.

FIGS. 10-12 illustrate another embodiment of the deflector having a right-hand spray pattern. FIG. 10 is a schematic end view of deflector 70. Right-hand spray nozzle deflector 70 is generally the same as deflector 14, except for the design of the deflection surface. Deflector 70 includes hex region 72 and recessed portion 74. Recessed portion 74 includes mating surface 75, fastener hole 76, one or more pin holes 78, and deflection surface 80. Deflection surface 80 includes radius portion 82 and flat portion 84.

Rather than directing the fluid to both sides of spray nozzle 10, deflector 70 is designed to direct fluid only to one side of spray nozzle 10. In this embodiment, recessed portion 74 extends roughly three-quarters of the way around the center of hex region 72. This design of recessed portion 74 adds an additional barricade to block the flow of fluid from spraying out of one side of spray nozzle 10. The resulting spray pattern has an angle from about 70 degrees to about 110 degrees.

A radius portion 82 is formed between mating surface 75 and flat portion 84. Radius portion 82 functions together with flat portion 84 and recessed portion 75 to distribute fluid into a uniform spray pattern from about 70 degrees to about 110 degrees.

FIG. 11 is a schematic side view of right-hand spray nozzle deflector 70. Deflector 70 includes hex region 72, recessed portion 74, deflection surface 80, and face 90. Deflection surface 80 includes radius portion 82 and flat portion 84. Face 90 is a side of hex region 72 opposite recessed portion 74.

FIG. 12 is a schematic front view of face 90 of right-hand spray nozzle deflector 70 including hex region 72. Hex region 72 includes fastener hole 76 and face 90. A logo or other identifying mark can be printed or etched into face 90 of deflector 70.

FIGS. 13-15 illustrate another embodiment of the deflector having a left-hand spray pattern. FIG. 13 is a schematic end view of deflector 100. Right-hand spray nozzle deflector 100 is generally the same as deflector 70, except that the deflector has been flipped 180 degrees to provide a spray pattern out from the opposite side of the deflector. Deflector 100 includes hex region 102 and recessed portion 104. Recessed portion 104 includes mating surface 105, fastener hole 106, one or more pin holes 108, and deflection surface 110. Deflection surface 110 includes radius portion 112 and flat portion 114.

FIG. 14 is a schematic side view of left-hand spray nozzle deflector 100. Deflector 100 includes hex region 102, recessed portion 104, deflection surface 110, and face 120. Deflection surface 110 includes radius portion 112 and flat portion 114. Face 120 is a side of hex region 102 opposite recessed portion 104.

FIG. 15 is a schematic front view of face 120 of right-hand spray nozzle deflector 100 including hex region 102. Hex region 102 includes fastener hole 106 and face 120. A logo or other identifying mark can be printed or etched into face 90 of deflector 70 if desired.

FIGS. 16-18 illustrate another embodiment of a deflector 130 having a left-hand deflection pattern. For example, when the deflector 130 is coupled with a body (e.g., body 12 shown in FIG. 3) and connected to a fluid source, the spray nozzle provides a uniform spray pattern having a range from about 70 degrees to about 110 degrees from the left side of deflector 130.

FIG. 16 is a schematic end view of left-hand deflector 130. FIG. 17 is a left side view of left-hand deflector 130. FIG. 18 is a front view of face 150 of deflector 130. Left-hand deflector 130 is similar to left-hand deflector 100, shown in FIG. 13, except for the design of the deflection surfaces 140. Deflector 130 includes hex region 132 and recessed portion 134. Hex region 132 includes a portion of fastener hole 136 and face 150. Recessed portion 134 includes mating surface 135, a portion of fastener hole 136, at least one pin hole 138, and deflection surface 140. Deflection surface 140 includes groove 142 and flat portion 144. Mating surface 135 is a surface of deflector 130 that is opposite and typically parallel to face 150.

Deflector 130 is designed to direct fluid only to one side of spray nozzle 10. In this embodiment, recessed portion 134 extends roughly three-quarters of the way around a central region of hex region 132. When connected with a body (e.g., body 12, shown in FIG. 3) recessed portion 134 functions to block the flow of fluid from spraying out from all but a region of the spray nozzle having an angle from about 70 degrees to about 110 degrees.

Groove 142 is formed within recessed portion 134 and is positioned between mating surface 135 and flat portion 144. In some embodiments, groove 142 includes a flat surface with sidewalls aligned from about 85 degree to about 95 degree angles to the flat portion 144. Groove 142 is formed, for example, using a flat tipped drill or router bit. In some embodiments, the flat surface of groove 142 is angled relative to mating surface 135, as illustrated. Also in some embodiments, the flat surface of groove 142 is angled relative to flat portion 144. For example, FIG. 17 includes angles A5 and A6. Angle A6 is the angle between surface 135 and the flat surface of groove 142. Angle A5 is in a range from about 0 degrees to about 25 degrees, and preferably from about 10 degrees to about 15 degrees. Angle A6 is the angle between surface 135 and flat portion 144. Angle A6 is in a range from about 0 degrees to about 20 degrees, and preferably from about 5 degrees to about 10 degrees.

Groove 142 functions together with flat portion 144 and recessed portion 134 to distribute fluid impinging upon the deflection surfaces 140 from the body (e.g., body 12 shown in FIG. 3) into a uniform spray pattern of approximately from about 70 degrees to about 110 degrees. Other embodiments can include other spray patterns, such as spray patterns of more or less than 90 degrees.

A spray nozzle including a body and a deflector can be more precisely aligned by the use of one or more pins. The pins (e.g., pin 36 shown in FIG. 4) can be sized to closely match the size of pin holes extending laterally into the body and the deflector. In this way the alignment of the body and the deflector is not dependent upon the precision of the fastener or fastener hole.

In some embodiments, the spray nozzle also includes only two mating surfaces between the body and the deflector. This reduces manufacturing costs and increases the quality of the seal between the body and the deflector. By providing a good seal, the spray nozzle is less likely to have fluid intrude between the body and deflector, thereby reducing the chance for dripping or fluid buildup on the spray nozzle.

It is noted that not all of the features characterized herein need to be incorporated within a given arrangement for the arrangement to include improvements according to the present disclosure. In addition, the specific embodiments illustrated and described are only a few examples of the full scope of embodiments contemplated. For example, the disclosure describes embodiments having roughly 90 degree and roughly 180 degree spray patterns. This disclosure also encompasses other spray nozzle embodiments having spray patterns of greater than 180 degrees, between 90 degrees and 180 degrees, and also less than 90 degrees. One skilled in the art will recognize that only minor modifications would be required to the illustrated embodiments to achieve these other desired spray patterns. These alternate spray nozzle designs are therefore also within the scope of this disclosure.

Furthermore, although this disclosure refers to a fastener connection (e.g. fastener 16 in FIG. 1) to connect the body with the deflector, it is recognized that a wide variety of fasteners could also be used. A fastener is any device or composition capable of connecting the mating surfaces of the body and the deflector. Such fasteners may not require the use of holes in the body and/or the deflector. For example, adhesive could be used to bond the body with the deflector at each of the mating surfaces or at each of the pins and pin holes.

In one aspect, the spray nozzle includes a body, a deflector, and a pin. The body includes a first mating surface, a first pin hole defined in the first mating surface, and a fluid orifice extending through the body and defining a fluid path. The deflector includes a second mating surface abutted with the first mating surface of the body, a second pin hole defined in the second mating surface and aligned with the first pin hole of the body, and a deflection surface from the first mating surface of the body and aligned with the fluid orifice; and a pin positioned in the first and second pin holes to align the fluid orifice and the deflection surface.

In another aspect, a kit is configured to be assembled into a spray nozzle. The kit includes a body, a first deflector, and a pin. The a body includes a first mating surface, a first pin hole extending into the body from the mating surface; and a fluid orifice defined in the first mating surface and defining a fluid path. The first deflector includes a second mating surface arranged to abut with the mating surface of the body when assembled, a second pin hole defined in the second mating surface and arranged for alignment with the first pin hole when assembled, and a deflection surface arranged in alignment with the fluid path and to be spaced from the mating surface of the body when assembled. The pin is sized for insertion within the first and second pin holes to precisely align the fluid orifice and the deflection surface.

Yet another aspect is a method of aligning a spray nozzle body with a spray nozzle deflector. The body includes a fluid orifice, and the deflector defining a deflector surface. The method includes: forming a first hole in a mating surface of the body; forming a second hole in a mating surface of the deflector; inserting a pin into the first and second holes; and applying a pressure to press the body mating surface against the deflector mating surface while maintaining alignment of the deflector surface with the fluid orifice.

Another aspect is a method of forming a spray nozzle. The method includes cutting a first segment and a second segment from length of stock rod; forming the first segment into a body having a first mating surface and a fluid orifice; forming the second segment into a deflector having a second mating surface; forming a first alignment hole in the first surface; forming a second alignment hole in the second surface; inserting a pin into the first and second holes; and applying a pressure to press the first surface against the second surface.

What is claimed is:

1. A spray nozzle comprising:

a body including:

a first mating surface;

a first pin hole defined in the first mating surface; and a fluid orifice extending through the body and defining a fluid path;

a deflector including:

a second mating surface abutted with the first mating surface of the body;

a second pin hole defined in the second mating surface and aligned with the first pin hole of the body; and a deflection surface from the first mating surface of the body and aligned with the fluid orifice;

a first pin positioned in the first and second pin holes to align the fluid orifice and the deflection surface; and wherein the body further comprises a third pin hole defined in the first mating surface, and wherein the deflector further comprises a fourth pin hole defined in the second mating surface, the spray nozzle further comprising a second pin located within the third and fourth pin holes to align the fluid orifice and the deflection surface.

2. The spray nozzle of claim 1, wherein the body further comprises a first fastener hole defined in the first mating surface, and the deflector further comprises a second fastener hole defined in the second mating surface, the spray nozzle further comprising a fastener located at least partially within the first and second fastener holes to connect the body and the deflector.

3. The spray nozzle of claim 2, wherein the second fastener hole extends through the deflector, the first fastener hole includes a plurality of threads, and the fastener extends through the deflector and at least partially into the body and includes a plurality of threads configured for threaded engagement with threads of the first fastener hole.

4. The spray nozzle of claim 1, wherein the body and the deflector are in direct contact only at the first mating surface and the second mating surface.

5. The spray nozzle of claim 1, wherein at least a portion of the deflection surface is arranged non-parallel to the first mating surface of the body.

6. The spray nozzle of claim 1, wherein the body further comprising:

a first portion including the first mating surface;

a hex region extending from the first portion opposite the first mating surface and including a second surface opposite the first portion; and an adapter extending from the second surface opposite the recessed portion arranged to engage with a fluid source.

7. The spray nozzle of claim 6, wherein the fluid orifice extends along a central axis of the body and through the adapter, the hex region, and the first portion.

8. The spray nozzle of claim 6, wherein the hex region of the body further comprises rounded corners.

9. The spray nozzle of claim 1, wherein the deflector further comprises:

a hex region including a face and a second surface opposite the face; and a recessed portion extending from the second surface, wherein the recessed portion includes the deflection surface formed therein.

10. The spray nozzle of claim 9, wherein the deflection surface is formed from a groove and a flat region adjacent the groove within the recessed portion.

11. The spray nozzle of claim 9, wherein the deflection surface includes a radius portion and a flat portion arranged adjacent to each other.

12. The spray nozzle of claim 9, wherein the spray nozzle is arranged to direct fluid from the spray nozzle to form about a 70 to about 110 degree spray pattern.

13. The spray nozzle of claim 9, wherein the spray nozzle is arranged to direct fluid from the spray nozzle to form about a 160 to about 200 degree spray pattern.

14. A kit configured to be assembled into a spray nozzle, the kit comprising:

a body including:

a first mating surface;

at least two body pin holes extending into the body from the mating surface; and a fluid orifice defined in the first mating surface and defining a fluid path;

a first deflector including:

a second mating surface arranged to abut with the mating surface of the body when assembled;

at least two deflector pin holes defined in the second mating surface and each deflector pin hole being arranged for alignment with one of the body pin holes when assembled; and a deflection surface arranged in alignment with the fluid path and to be spaced from the mating surface of the body when assembled; and at least two pins, each being pin sized for insertion within one of the at least two body pin holes and one of the at least two deflector pin holes to precisely align the fluid orifice and the deflection surface.

15. The kit of claim 14, wherein the deflection surface is arranged to provide a spray pattern selected from a right-hand spray pattern, a left-hand spray pattern, and a full spray pattern.

16. The kit of claim 14, further comprising a second deflector, the second deflector including:

a third mating surface arranged to abut with the mating surface of the body when assembled;

a third pin hole defined in the third mating surface and arranged for alignment with the first pin hole when assembled; and a second deflection surface arranged in alignment with the fluid path and to be spaced from the mating surface of the body when assembled and arranged to provide a spray pattern selected from a right-hand spray pattern, a left-hand spray pattern, and a full spray pattern.

17. A spray nozzle comprising:

a body including:

a first mating surface;

a first pin hole defined in the first mating surface; and a fluid orifice extending through the body and defining a fluid path;

a deflector including:

a second mating surface abutted with the first mating surface of the body;

a second pin hole defined in the second mating surface and aligned with the first pin hole of the body; and a deflection surface from the first mating surface of the body and aligned with the fluid orifice;

a hex region including a face and a second surface opposite the face; and a recessed portion extending from the second surface, wherein the recessed portion includes the deflection surface formed therein; and a pin positioned in the first and second pin holes to align the fluid orifice and the deflection surface.

18. The spray nozzle of claim 17, wherein the body further comprises a first fastener hole defined in the first mating surface, and the deflector further comprises a second fastener hole defined in the second mating surface, the spray nozzle further comprising a fastener located at least partially within the first and second fastener holes to connect the body and the deflector.

19. The spray nozzle of claim 18, wherein the second fastener hole extends through the deflector, the first fastener hole includes a plurality of threads, and the fastener extends through the deflector and at least partially into the body and includes a plurality of threads configured for threaded engagement with threads of the first fastener hole.

20. The spray nozzle of claim 17, wherein the body and the deflector are in direct contact only at the first mating surface and the second mating surface.

21. The spray nozzle of claim 17, wherein at least a portion of the deflection surface is arranged non-parallel to the first mating surface of the body.

22. The spray nozzle of claim 17, wherein the body further comprising:

a first portion including the first mating surface;

a hex region extending from the first portion opposite the first mating surface and including a second surface opposite the first portion; and an adapter extending from the second surface opposite the recessed portion arranged to engage with a fluid source.

23. The spray nozzle of claim 22, wherein the fluid orifice extends along a central axis of the body and through the adapter, the hex region, and the first portion.

24. The spray nozzle of claim 22, wherein the hex region of the body further comprises rounded corners.

25. The spray nozzle of claim 17, wherein the body further comprises a third pin hole defined in the first mating surface, and wherein the deflector further comprises a fourth pin hole defined in the second mating surface, the spray nozzle further comprising a second pin located within the third and fourth pin holes to align the fluid orifice and the deflection surface.

26. The spray nozzle of claim 17, wherein the deflection surface includes a radius portion and a flat portion arranged adjacent to each other.

27. The spray nozzle of claim 17, wherein the spray nozzle is arranged to direct fluid from the spray nozzle to form about a 70 to about 110 degree spray pattern.

28. The spray nozzle of claim 17, wherein the spray nozzle is arranged to direct fluid from the spray nozzle to form about a 160 to about 200 degree spray pattern.

* * * * *